US005602092A

United States Patent [19]

Repinec, Jr. et al.

[11] Patent Number: 5,602,092

[45] Date of Patent: Feb. 11, 1997

[54] CONCENTRATED AQUEOUS LIQUID DETERGENT COMPOSITIONS CONTAINING DEFLOCCULATING POLYMERS

[75] Inventors: Stephen T. Repinec, Jr., Flemington; Marianne Zappone, Mount Holly; Robert L. Fuller, Asbury; Santhana V. Krishnan, Randolph, all of N.J.

[73] Assignee: Colgate-Palmolive Company, New York, N.Y.

[21] Appl. No.: 529,936

[22] Filed: Sep. 18, 1995

Related U.S. Application Data

[63] Continuation-in-part of Ser. No. 271,299, Jul. 6, 1994.

[51] Int. Cl.[6] ..... C11D 3/37; C11D 11/00; C11D 17/08

[52] U.S. Cl. ..... 510/434; 510/108; 510/340; 510/346; 510/361; 510/476; 510/477; 510/492; 510/493

[58] Field of Search ..... 252/174.24, 174.23, 252/173, 174, 549, 551, 174.21, 530, 531, DIG. 4, DIG. 14

[56] References Cited

U.S. PATENT DOCUMENTS

| | | | |
|---|---|---|---|
| 3,668,230 | 6/1972 | Dannals | 260/465.4 |
| 3,772,382 | 11/1973 | Dannals | 260/481 |
| 3,776,874 | 12/1973 | Dannals | 260/29.6 |
| 3,839,405 | 10/1974 | Dannals | 260/465.4 |
| 3,940,356 | 2/1976 | Byrnes | 260/29.6 |
| 4,556,504 | 12/1985 | Rek | 252/135 |
| 4,715,969 | 12/1987 | Rothanavibhata et al. | 252/8.7 |
| 4,836,948 | 6/1989 | Corring | 252/99 |
| 4,941,988 | 7/1990 | Wise | 252/99 |
| 5,053,158 | 10/1991 | Dixit et al. | 252/99 |
| 5,221,495 | 6/1993 | Cao | 252/135 |
| 5,364,553 | 11/1994 | Cao | 252/174.12 |
| 5,395,547 | 3/1995 | Broadwell et al. | 252/97 |
| 5,489,397 | 2/1996 | Bainbridge | 252/174.24 |

FOREIGN PATENT DOCUMENTS

| | | |
|---|---|---|
| 1310730 | 12/1989 | Japan . |
| 0322946 | 7/1989 | United Kingdom . |

OTHER PUBLICATIONS

"Creating Emulsions with Carbopol 1600–Series Polymrs"; BF Goodrich Bulletin, DET–4 (trade literature), Dec. 1994.

*Primary Examiner*—Paul Lieberman
*Assistant Examiner*—Lorna M. Douyon
*Attorney, Agent, or Firm*—Bernard Lieberman; James M. Serafino

[57] ABSTRACT

Concentrated, structured liquid detergent compositions in the form of lamellar surfactant droplets dispersed in an aqueous electrolytic continuous phase comprises a mixture of:

a) from about 10 to 45% by weight of surfactant;

b) at least one detergent builder;

c) from about 0.01 to about 5% by weight of a deflocculating polymer composition containing polymer chains of the structure P-QR, wherein P represents a polymer chain segment of a hydrophilic polymer, and QR represents a hydrophobic end-cap group wherein R is an organic hydrophobic radical containing from about 4 to 28 carbon atoms, and Q is selected from the group consisting of O, S, SO, $SO_2$, Si OR'R", Si R'R", CR'OH, CR'R" and CR'OR" wherein R' and R" are each hydrogen, an alkyl group containing from 1 to 4 carbon atoms or an aryl group; and d) water There is also added a polymeric stabilizing agent to the liquid detergent compositions which is comprised of a high molecular weight cross-linked polyacrylic acid compound for the purpose of maintaining the viscosity of the liquid detergent composition substantially constant when stored at room temperature for a period of at least four weeks.

30 Claims, No Drawings

CONCENTRATED AQUEOUS LIQUID DETERGENT COMPOSITIONS CONTAINING DEFLOCCULATING POLYMERS

This application is a continuation-in-part of copending application Ser. No. 08/271,299 filed Jul. 6, 1994, the entire disclosure of which is incorporated herein by reference.

BACKGROUND OF THE INVENTION

1. Field of the Invention

This invention relates to concentrated aqueous liquid detergent compositions containing an end-capped hydrophilic polymer as a deflocculating agent, such polymer being preferably terminated with an alkyl sulfide, alkyl sulfoxide or alkyl sulfone end-cap group. The liquid detergent compositions may also contain a high molecular weight cross-linked polyacrylic acid compound as a stabilizing agent to maintain the viscosity substantially constant during storage and prevent the continuous loss of viscosity over time, a characteristic behavior of certain concentrated detergent compositions.

2. Description of the Related Art

Heavy duty liquid detergents useful for machine washing of laundry are well known materials which have been described in a number of patents and in the literature. They are generally aqueous compositions comprising at least one or a compatible mixture of two or more detergent active surfactants selected from anionic, cationic, nonionic, zwitterionic and amphoteric species. Such compositions also generally contain detergency builder components and/or sequestering agents such as inorganic phosphates or phosphonates, alkali metal carbonates, alkali metal aminopolycarboxylates such as salts of nitrilotriacetic acid and salts of ethylenediamine-tetraacetic acid, alkali metal silicates, aluminosilicates, various zeolites and mixtures of two or more of these. Other components which may be present in such compositions include a clay material such as bentonite present as a fabric softener, optical brighteners, enzymes and their stabilizers, perfumes, colorants, antifoaming agents, e.g. silicone compounds, preservatives and like known additives.

A particular category of liquid detergents are the so called structured liquids comprising lamellar droplets (micelles) dispersed in an aqueous electrolyte phase. The lamellar droplets consist of an onion-like configuration of concentric bi-layers of surfactant molecules between which layers are trapped water or electrolyte solution. Such liquids may also contain suspended solids such as the water insoluble builders and clays referred to above.

There is a trend in the industry to provide detergent compositions having a higher concentration of active ingredients (payload), including surfactants. These include detergent concentrates containing about 10 to 25% by weight of surfactant and super concentrates containing from about 25 to 45% by weight surfactant. However, as the level of surfactant is increased, the volume fraction of lamellar droplets suspended is also increased, resulting in a diminished spacing between droplets. Contact of the suspended lamellar droplets with one another can lead to a congealing or flocculation phenomenon, resulting in a marked increase in the viscosity of the detergent composition due to formation of a network throughout the liquid. Liquids containing flocculated lamellar droplets are unacceptable because of phase separation and a difficulty in pouring such liquids from their containers.

One approach to enhance the stability of such compositions is the inclusion of minor amounts, e.g., 0.01 to 5% by weight, of a deflocculating polymer into the detergent formulation. For example, U.S. Pat. No. 5,147,576 discloses random interpolymers derived from hydrophilic monomers, such as acrylic acid, and also containing one or more copolymerized monomers having pendant hydrophobic side chains randomly dispersed along the polymer chain. Use of these interpolymers in detergent compositions is disclosed to hinder or prevent flocculation of lamellar surfactant droplets dispersed in the detergent, and thus enhance stability.

Hydrophilic polymeric materials have also been used in liquid detergent compositions as viscosity control agents. For example, U.S. Pat. No. 4,715,969 and its counterpart UK 2,168,717 disclose that the addition of less than about 0.5% by weight of a polyacrylate polymer, e.g. sodium polyacrylate, having a molecular weight from about 1,000 to 5,000, to aqueous detergent compositions containing primarily anionic surfactants will stabilize the viscosity of the composition and prevent a major increase in viscosity after a period of storage of the formulated composition. Also, EPO 301,883 discloses similar compositions containing from about 0.1 to 20% by weight of a viscosity reducing, water soluble polymer such as polyethylene glycol, dextran or a dextran sulfonate. U.S. Pat. Nos. 3,668,230; 3,839,405; 3,772,382; and 3,776,874 issued to Uniroyal, Inc. disclose alkyl sulfide, alkyl sulfoxide and alkyl sulfone terminated oligomers for use in emulsion polymerization. The oligomers are broadly stated to be useful as surface active agents, emulsifiers and thickeners.

EP 623670A describes the use of stabilizers in an aqueous surfactant composition to reduce the flocculation of systems containing a flocculable surfactant. The stabilizers are described as surfactants having a hydrophobic portion and a hydrophilic portion. The hydrophilic portion is typically a polymer linked at one end to the hydrophobic portion.

While the problems of phase separation and flocculation noted above which are frequently associated with concentrated liquid detergent compositions have been generally addressed in the prior art by the use of deflocculating polymers, there, nevertheless, remains for certain of the resulting liquid detergent compositions, depending on the particular composition and method of manufacture, the problem of a continuous viscosity "decay" or viscosity loss during storage eventually resulting in phase separation. Viscosity losses on the order of 40% or more over a four week period during storage are commonly observed in some compositions, and particularly at temperatures substantially above room temperature. For commercial concentrated liquid detergent products which typically have a target viscosity of from 2,000 to 8,000 cps, a decrease in viscosity of 40% or more during storage relative to its initial value represents a readily observable change in the pourability of the composition, a drawback which may adversely affect consumer acceptability.

Accordingly, one aspect of the present invention provides for the use of a high molecular weight cross-linked polyacrylic acid compound as a viscosity stabilizer for those concentrated liquid detergent compositions characterized by the above-described viscosity decay. As a general proposition, polyacrylic acid type polymers are well known, particularly in the machine dishwashing art, but, primarily for their thickening properties. Thus, for example, U.S. Pat. No. 5,053,158 to Dixit describes the use of high molecular weight cross-linked acrylic acid polymers as thickeners to provide the desired-thickening and viscous properties in a liquid automatic dishwasher detergent composition.

In U.S. Pat. No. 4,836,948, a cleaning composition in gel form is described for use in an automatic dishwasher. Certain desired viscoelastic properties of the gel are obtained by the use of a cross-linked polycarboxylate polymer, especially a cross-linked polyacrylic acid.

U.S. Pat. No. 4,715,969 to Rothanavibhata describes liquid detergent compositions which contain low molecular weight polyacrylate in amounts up to 0.5% to prevent the viscosity from increasing during storage to the extent that it interferes with the pourability of the liquid composition.

The use of linear polyacrylates having molecular weights above 4,500 is noted in the patent literature to be detrimental to the stability of built aqueous alkaline liquid compositions. In EP 322 946, for example, the patentee states that experimentation with polyacrylates of varying molecular weights has shown that for built alkaline liquid compositions containing a polyacrylate, the loss of physical stability becomes much worse as the molecular weight of the polyacrylate increases.

Accordingly, the prior art has yet to address itself to the general problem of viscosity loss over time which occurs in certain concentrated liquid detergent compositions and particularly at elevated temperatures, and has heretofore, been unaware of the beneficial effect which high molecular weight cross-linked polyacrylates have in stabilizing and substantially preventing the occurrence of such viscosity loss.

SUMMARY OF THE INVENTION

The present invention provides for a concentrated, structured liquid detergent composition (CLDC) in the form of lamellar surfactant droplets dispersed in an aqueous electrolytic continuous phase, comprising a mixture of:

a) from about 10 to 45% by weight of surfactant;

b) at least one detergent builder;

c) from about 0.01 to about 5% by weight of a deflocculating polymer composition containing polymer chains of the structure P-QR, wherein P represents a polymer chain segment of a hydrophilic polymer, and QR represents a hydrophobic end-cap group wherein R is an organic hydrophobic radical containing from about 4 to 28 carbon atoms, and Q is selected from the group consisting of O, S, SO, $SO_2$, Si OR'R", Si R'R", CR'OH, CR'R" and CR'OR" wherein R' and R" are each hydrogen, an alkyl group containing from 1 to 4 carbon atoms or an aryl group; and d) water The presence of the deflocculating polymer in the composition both stabilizes the detergent composition and retards the propensity of the lamellar droplets dispersed in the aqueous electrolytic phase to flocculate, particularly where the droplets occupy a higher volume ratio as the result of high concentrations of surfactant present in the detergent. The invention also provides both phosphate built and non-phosphate built detergent compositions having a viscosity in the range of from about 500 to 20,000 cps, more preferably from about 2,000 to 10,000 cps, having improved flowability and stability.

The present invention also provides for a concentrated liquid detergent composition (CLDC) capable of maintaining a substantially constant viscosity upon storage at room temperature for a period of at least four weeks, by including in the above-described CLDC a polymeric stabilizing agent comprised of a high molecular weight cross-linked polyacrylic acid compound having a molecular weight greater than about one million in an amount from about 0.01 to 0.5% by weight sufficient to stabilize the viscosity of the CLDC such that over a four week period of aging at 43° C. its viscosity after four weeks is substantially the same or higher than the initial viscosity; and wherein by comparison a concentrated liquid detergent composition having the same composition as the aforesaid stabilized CLDC except for the absence of said polymeric stabilizing agent is characterized by a continuously decreasing viscosity whereby its viscosity after four weeks of aging at 43° C. is more than about 40% below the initial viscosity.

In addition to stabilizing viscosity, the presence of the polymeric stabilizing agent as used herein has another unexpected benefit, namely, it prevents the formation of a mottled or inhomogeneous appearance in the product. Such inhomogeneity is, in fact, another aspect of product instability which often manifests itself at room temperature, but particularly at elevated temperatures. Accordingly, the polymeric stabilizing agent may be added to the CLDC to address either or both of the aforementioned problems of instability.

In accordance with another aspect of the invention, there is provided a process for preparing a concentrated liquid detergent composition (CLDC) capable of maintaining a substantially constant viscosity upon storage at room temperature for a period of at least four weeks comprising the steps of:

(a) providing a mixing vessel containing a mixture of:

(i) water;

(ii) a polymeric stabilizing agent comprised of a high molecular weight cross-linked polyacrylic acid compound having a molecular weight greater than about one million in an amount to provide from about 0.05 to 0.5% by weight of said stabilizing agent in the prepared CLDC, said amount being sufficient to stabilize the viscosity of the CLDC such that over a four week period of aging its viscosity after four weeks is substantially the same or higher than the initial viscosity; and (iii) a source of alkalinity to neutralize said polymeric stabilizing agent, (b) adding with agitation to the mixing vessel of (a), the following components:

(i) at least one detergent builder in an amount to provide at least about 5% by weight of the CLDC;

(ii) surfactant in an amount to provide from about 10 to 45% by weight of the CLDC;

(iii) a deflocculating polymer composition having a weight average molecular weight no greater than about 50,000 in an amount to provide from about 0.01 to about 5% by weight of the CLDC; and (iv) optionally minor additives such as perfume, preservative and brightener.

The precise order of addition of the ingredients introduced into the mixing vessel in step (b) above is not critical and will depend, to a great extent, on the specific ingredients, type of mixing apparatus and desired characteristics in the final product. For ease of mixing it is generally preferred to introduce the detergent builder prior to addition of the surfactant. The minor additives such as perfume, enzyme, brightener, colorant, and the like are ordinarily the last ingredients added to the mixing vessel.

For purposes of the present invention, the stability of the concentrated liquid detergent composition with regard to viscosity loss and ultimately phase separation at room temperature, is measured by an accelerated aging test conducted for four weeks at the elevated temperature of 43° C. (or 110° F.). The critical criterion which effectively translates into a prediction of stability at room temperature is the avoidance of a viscosity loss over the aforementioned four week period of aging. A rise in viscosity which often occurs during storage at the elevated temperature is attributable to such high temperature and is not an indication that similar rheological behavior is likely to occur at room temperature, the temperature of most interest from a commercial standpoint. Moreover, while a viscosity increase may be tolerated in a commercial product provided it remains pourable, a viscosity loss is an indication of product instability.

Accordingly, the manifestation of a substantially-constant viscosity or an increase in viscosity over the course of the accelerated aging test is a key indicator of the desired stability of the concentrated liquid detergent composition and its ability to maintain a constant viscosity at room temperature for a period of time sufficient for its commercial consumption by consumers.

DETAILED DESCRIPTION OF THE INVENTION

The detergent compositions of the invention contain one or a compatible mixture of two or more detergent active surfactants which may be selected from anionic, cationic nonionic, zwitterionic and amphoteric species.

Suitable anionic detergents include the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–C18) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic detergents are sodium ($C_{10}$–$C_{16}$) linear alkyl benzene sulfonates, ($C_{10}$–$C_{18}$) alkyl polyethoxy sulfates and mixtures thereof.

The more preferred anionic detergent is a mixture of linear or branched (preferably linear) higher alkylbenzene sulfonate and alkyl polyethoxy sulfate. While other water soluble linear higher alkylbenzene sulfonates may also be present in the formulas of the present invention, such as potassium salts and in some instances the ammonium and/or alkanolammonium salts, where appropriate, it has been found that the sodium salt is highly preferred, which is also the case with respect to the alkyl polyethoxy sulfate detergent component. The alkylbenzene sulfonate is one wherein the higher alkyl group is of 10 to 16 carbon atoms, preferably 12 to 15, more preferably 12 to 13 carbon atoms. The alkyl polyethoxy sulfate, which also may be referred to as a sulfated polyethoxylated higher linear alcohol or the sulfated condensation product of a higher fatty alcohol and ethylene oxide or polyethylene glycol, is one wherein the alkyl group is of 10 to 18 carbon atoms, preferably 12 to 15 carbon atoms, and which includes 2 to 11 ethylene oxide groups, preferably 2 to 7, more preferably 3 to 5 and most preferably about 3 ethylene oxide groups.

The anionic detergent may be present in the composition at a level of from about 10 to about 45% by weight, more preferably from about 15 to about 40% by weight. Where mixtures of two or more different anionic detergents are used, such as the sulfate and sulfonate mixtures described above, they may be mixed in the relative proportions in the range of about 5 to 95% by weight of each type.

The composition of this invention may also contain supplementary nonionic and amphoteric surfactants. Suitable nonionic surfactants include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethoxylated sorbitans and ethoxylated phosphate esters.

The preferred non-ionic detergent compounds are those of the ethoxylated and mixed ethoxylated-propyloxylated ($C_6$–$C_{18}$) fatty alcohol type. The nonionic surfactants may be present in the composition at a preferred level of from about 1 to 15% by weight.

It is also possible to include an alkali metal soap of a mono-or di-carboxylic acid, especially a soap of an acid having from 12 to 18 carbon atoms, for example oleic acid, ricinoleic acid, alk(en)yl succinate, for example dodecenyl succinate, and fatty acids derived from castor oil, rapeseed oil, groundnut oil, coconut oil, palmkernel oil or mixtures thereof. The sodium or potassium soaps of these acids can be used. When used, the level of soap in compositions of the invention is from about 0.5 to 15% by weight of the composition.

Particularly preferred combinations of surfactants include:

1. A mixture which comprises about 15 to 30% by wt. of linear alkylbenzene sulfonate wherein the alkyl group contains from about 10 to 16 carbon atoms; and about 1 to 10% by wt. of alkyl polyethoxy sulfate wherein the alkyl contains from about 10 to 18 carbon atoms and the polyethoxy is of 2 to 8 ethylene oxide groups.
2. A mixture which comprises one or both of the anionic surfactants listed in 1 above and a nonionic ethoxylated fatty alcohol wherein the fatty alcohol is of 8 to 18 carbon atoms and the polyethoxy is of 2 to 7 oxide groups. The anionic to nonionic surfactant ratio is from about 1:4 to 10:1.

A more detailed illustration of the various detergents and classes of detergents mentioned may be found in the text

*Surface Active Agents*, Vol. II, by Schwartz, Perry and Berch (Interscience Publishers, 1958), in a series of annual publications entitled *McCutcheon's Detergents and Emulsifiers*, issued in 1969, or in *Tensid-Taschenbuch*, H. Stache, 2nd Edn. Carl Hanser Verlag, Munich and Vienna, 1981.

The composition of this invention also includes at least one detergent builder. Suitable builders include phosphorous-containing inorganic salts, organic builders and non-phosphorous-containing builders. The prime function of the builder is to complex with hard water cations which form salts insoluble in water, for example calcium and magnesium cations, through the mechanism of sequestration or cation exchange.

Examples of phosphorous-containing inorganic detergency builders include the water-soluble salts, especially alkali metalpyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used. Examples of organic detergency builders which may be used include the alkali metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids, tartrate mono succinate, tartrate di succinate, alk(en)yl succinates and citric acid. Other organic detergency builders include water-soluble alkali metal carbonates and bicarbonates, as well as mixtures thereof with phosphates, e.g., a mixture of sodium carbonate and sodium tripolyphosphate.

In one embodiment of this invention, the liquid detergent is free of phosphorous-containing builders. Preferred builders for use in phosphorous-free compositions include alkali metal silicates in finely divided form, and particularly cation-exchanged amorphous or crystalline aluminosilicates (zeolites) of natural or synthetic origin. Suitable aluminosilicate zeolites include "zeolite A", "zeolite B", "zeolite X", "zeolite Y" and "zeolite HS". The more preferred zeolite is crystalline sodium silicoaluminate zeolite A. Preferably, the zeolite should be in a finely divided state with the ultimate particle diameters being up to 20 microns, e.g., 0.005 to 20 microns, preferably from 0.01 to 15 microns and more preferably of 0.01 to 8 microns mean particle size, e.g. 3 to 7 microns, if crystalline, and 0.01 to 0.1 microns if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not be sufficiently and satisfactorily suspended.

In another embodiment of the invention where phosphorous-free builders are used, the builder may comprise water soluble nonphosphorous containing compounds which dissolve in the aqueous phase of the composition forming an electrolyte solution. Examples of such builders include the alkali metal carboxylates referred to above, e.g., sodium citrate, used alone or in a mixture with water soluble alkali metal carbonates or bicarbonates, e.g., sodium or potassium carbonate. Mixtures containing two or more of the above described detergency builders may also be employed. The builder or mixture of builders may be present in the composition in the range of from about 5 to about 40% by weight of the composition, more preferably from about 8 to about 30% by weight. Where the builder is a zeolite material, it is normally present in the range of from about 5 to 30% by weight of the composition, and may be used in combination with other compatible builder materials.

A key ingredient in the compositions of the present invention is the deflocculating polymer which both stabilizes the detergent formulation and decreases the viscosity of such formulations. The hydrophobic end groups present in the otherwise hydrophilic polymer become enveloped in the lamellar droplets formed by the surfactant phase, thereby both sterically and electrostatically inhibiting flocculation of these droplets, even at relatively high concentrations. This results in a stable, lower viscosity product.

Deflocculating polymers useful in accordance with this invention are characterized as comprising a hydrophilic polymer chain segment (P) having a hydrophobic moiety (QR) covalently attached to a terminal carbon atom present in at least some of the hydrophilic chain segments. These polymers may be generally characterized as containing the structure P-QR wherein P represents the hydrophilic polymer and R is an organic hydrophobic radical containing from about 4 to 28 carbon atoms, more preferably an alkyl radical containing from about 6 to 18 carbon atoms.

Q represents a group or molecule which is capable of linking the hydrophilic polymer P with the organic hydrophobic radical R and thereby acts as a polymer chain terminator (or initiator). In general, Q may be selected from the group consisting of O, S, SO, $SO_2$, Si OR'R", Si R'R", CR'OH, CR'R" and CR'OR" wherein R' and R" are each hydrogen, an alkyl group containing 1 to 4 carbon atoms or an aryl group. R is a $C_4$–$C_{28}$ alkyl, alkenyl or aralkyl group, preferably an alkyl or aralkyl group containing 6 to 18 carbon atoms. The preferred polymers of the invention are terminated with an alkyl sulfide, alkyl-sulfoxide or alkyl-sulfone end-cap group.

Monomers which may be polymerized to form the hydrophilic polymer segment include one or a mixture of water soluble monomers or a combination of water soluble and relatively water insoluble monomers such that the resulting polymers are water soluble at ambient temperatures to the extent of greater than about 10 grams per liter. Examples of suitable such monomers include ethylenically unsaturated amides such as acrylamide, methacrylamide and fumaramide and their N-substituted derivatives such as 2-acrylamido-2-methylpropane sulfonic acid, N-(dimethylaminomethyl) acrylamide as well as N-(trimethylammoniummethyl) acrylamide chloride and N-(trimethylammoniumpropyl) methacrylamide chloride; ethylenically unsaturated carboxylic acids or dicarboxylic acids such as acrylic acid, maleic acid, methacrylic acid, itaconic acid, fumaric acid, crotonic acid, aconitic acid and citraconic acid; and other ethylenically unsaturated quaternary ammonium compounds such as vinyl-benzyl trimethyl ammonium chloride; sulfoalkyl esters of unsaturated carboxylic acids such as 2-sulfoethyl methacrylate; aminoalkyl esters of unsaturated carboxylic acids such as 2-aminoethyl methacrylate, dimethyl aminoethyl (meth)acrylate, diethyl aminoethyl (meth-)acrylate, dimethyl aminomethyl (meth)acrylate, diethyl aminomethyl (meth)acrylate, and their quaternary ammonium salts; vinyl or allyl amines such as vinyl pyridine and vinyl morpholine or allylamine; diallyl amines and diallyl ammonium compounds such as diallyl dimethyl ammonium chloride; vinyl heterocyclic amides such as vinyl pyrrolidone; vinyl aryl sulfonates such as vinylbenzyl sulfonate; vinyl alcohol obtained by the hydrolysis of vinyl acetate; acrolein; allyl alcohol; vinyl acetic acid; sodium vinyl sulphonate; sodium allyl sulphonate, as well as the salts of the foregoing monomers. These monomers may be used singly or as mixtures thereof.

Optionally, the hydrophilic polymer segment may contain small amounts of relatively hydrophobic units, e.g., those derived from polymers having a solubility of less than 1 g/l in water, provided that the overall solubility of the hydrophilic polymer still satisfies the solubility requirements as specified above. Examples of relatively water insoluble polymers are polyvinyl acetate, polymethyl methacrylate, polyethyl acrylate, polyethylene, polypropylene, polystyrene, polybutylene oxide, polypropylene oxide and polyhydroxypropyl acrylate.

A particular class of preferred alkyl sulfide terminated polymers in accordance with the invention may be represented by the following structural formula:

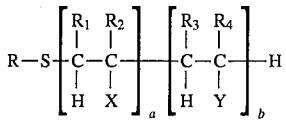

where R is a straight or branched chain primary, secondary, or tertiary alkyl group having 5 to 20 carbon atoms; $R_1$ and $R_3$ are each hydrogen, methyl, ethyl, or —COOH; $R_2$ and $R_4$ are each hydrogen, methyl, ethyl, —COOH, or —$CH_2COOH$; Y is selected from the group consisting of —COOH, —$CONH_2$, —$OCH_3$, —$OC_2H_5$, and —$CH_2OH$; X is selected from the group consisting of —$COOC_2H_4OH$, —$COOC_3H_6OH$, —$CONHCH_2OH$, —$CONHCH_3$, —$CONHC_2H_5$, —$CONHC_3H_7$, —$COOCH_3$, —$COOC_2H_5$, —CN, —$OOCCH_3$, —$OOCC_2H_5$, and —$COOCH_3CHOCH_2$. The degree of polymerization, a+b, is generally between 2 and 50, and the mole fraction of the monomer having the X functional group, a/(a+b), may vary from 0 to 0.6, and is preferably less than 0.5 and most preferably is 0.2 to 0.5. The presence of a monomer having the X functional group is optional hence the value of "a" will be zero for polymers containing only monomers having a Y functional group. A comprehensive description of these alkyl sulfide terminated polymers and their method of preparation is disclosed in U.S. Pat. No. 3,839,405, the complete disclosure of which is incorporated herein by reference.

Particularly preferred polymers for use herein comprise a hydrophilic polymer terminated by a hydrophobic mercapto end-cap group derived from a mercaptan having the structure RSH, where R is an alkyl or aralkyl radical having 4 to 28 carbon atoms. R should be of sufficient chain length such that it exhibits oleophilic properties, i.e., it is miscible with the oily lamellar droplet or micelle phase of the detergent composition. Preferably, the mercaptans are alkyl or aralkyl mercaptans containing about 6 to 18 carbon atoms such as hexyl mercaptan, decyl mercaptan, dodecylbenzyl mercaptan, dodecyl mercaptan and octadecyl mercaptan.

The hydrophilic polymer backbone may also be advantageously chain terminated with a sulfoxide or a sulfone group. A class of preferred polymers for use herein may be represented by the following structural formula:

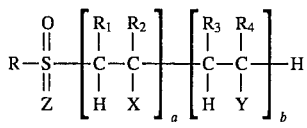

wherein R, $R_1$, $R_2$, $R_3$, $R_4$, X, Y, the degree of polymerization a+b, and the mole fraction a/(a+b) are as defined above; Z is either oxygen or not present. When Z is oxygen the end-cap group is an alkyl sulfone; when Z is not present the end-cap group is an alkyl sulfoxide. A comprehensive description of these type alkyl-sulfoxide and alkyl-sulfone terminated polymers and their method of preparation is disclosed in U.S. Pat. Nos. 3,772,382; 3,776,874; and 3,668,230, the complete disclosures of which are incorporated herein by reference.

By example, mercapto terminated polymers may be prepared by free radical polymerization of the hydrophilic monomer or monomer mixture in an aqueous or water/alcohol medium in the presence of a water soluble free radical initiator and in the presence of an RSH mercaptan. The molar ratio of monomer to mercaptan may generally range from about 10:1 to about 150:1 respectively, more preferably from about 25:1 to about 100:1 respectively. Under free radical polymerization conditions, a number of RS free radicals will be generated which may serve to initiate polymerization of additional monomer or these radicals can couple with a growing polymer chain, resulting in a mixed polymer product wherein at least some of the chains have the structure P-QR as described above. The number of P and P-QR chains present in the mixed polymer product will vary depending on polymerization conditions, average molecular weight of the polymer and the quantity of mercaptan present in the polymerization mixture. Preferably from about 25 up to about 95% of the polymer chains are end-capped by the SR mercapto hydrophobe.

Polymerization may be conducted by the general procedures described in U.S. Pat. No. 5,021,525, the complete disclosure of which is incorporated herein by reference. The preferred aqueous polymerization medium comprises a mixture of at least 50% by weight of water and miscible cosolvent such as a $C_1$ to $C_4$ alcohol, e.g., isopropanol, which tends to retard precipitation of the developing end-capped polymer from solution. Polymerization initiators which may be used include water soluble initiators such as hydrogen peroxide, persulfates, perborates and permanganates, present in solution at levels generally in the range of from about 0.1 to 5% by weight.

Polymerization may be conducted by initially charging an initiator, e.g. sodium persulfate, into an aqueous polymerization medium, followed by gradual introduction of a mixture comprising monomer and mercaptan into the medium at a level of from about 10 to 55% by weight of total reactants, and heating the mixture at a temperature in the range of from about 70° to 99° C. for a period of time sufficient to form polymer of the desired molecular weight, generally from about 3 to 6 hours. Preferably, only a portion of the monomer and initiator is added to the medium initially, followed by the addition of remaining monomer and initiator later during the polymerization. The polymer may then be recovered by stripping the cosolvent, e.g., isopropanol and at least part of the water, followed by neutralization of the polymer with caustic, e.g., sodium hydroxide.

Preferred deflocculating polymers useful for the purposes of this invention have a weight average molecular weight, as measured by gel permeation chromatography using polyacrylate standards, in the range of from about 200 to 50,000, more preferably from about 200 to 25,000 and most preferably for polymers based on polyacrylic and polymethacrylic acid, from about 3,000 to 10,000. The most preferred polymers are hydrophilic homopolymers such as polyacrylic or polymethacrylic acid and copolymers of acrylic or methacrylic acid with less than 50 wt % of maleic acid (anhydride), wherein the bulk of the polymer chains are end-capped with a single hydrophobic segment derived from dodecyl mercaptan.

These polymers and their method of preparation are further disclosed in copending U.S. application Ser. No.

08/212,611, filed on Mar. 14, 1994, the complete disclosure of which is incorporated herein by reference.

The deflocculating polymers are incorporated into the liquid detergent composition at a concentration sufficient to prevent or at least retard the propensity of the electrolyte-dispersed lamellar surfactant droplets to flocculate and thereby provide liquid detergent compositions having lower viscosities than otherwise identical compositions which do not contain the deflocculating polymer. The level of addition may range from about 0.01 to about 5% by weight, more preferably from about 0.25 to about 1.5% by weight and most preferably from about 0.4 to about 1.0% by weight, based on the weight of the liquid detergent composition.

The polymeric stabilizing agents useful for the present invention are comprised of cross-linked polyacrylic acid compounds having molecular weights generally above about 1 million, and which preferably contain a hydrophobic group incorporated into the hydrophilic polyacrylic acid backbone of the polymer. These polymers are products sold under the Carbopol® trademark by B. F. Goodrich Company, the Carbopol® 1600-Series polymers being particularly preferred.

The Carbopol® resins in general are hydrophilic high molecular weight, cross-linked acrylic acid polymers having an average equivalent weight of 76, and having the general structure shown in the formula below:

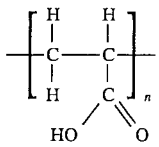

The polyacrylic acid compounds referred to herein include polymers of acrylic acid or water-dispersible or water-soluble salts, esters or amides thereof, or water-soluble copolymers of these acids, or the salts, esters or amides with each other or with one or more other ethylenically unsaturated monomers, such as, for example, styrene, maleic acid, maleic anhydride, 2-hydroxyethylacrylate, acrylonitrile, vinyl acetate, ethylene, propylene, and the like.

These homopolymers or copolymers are characterized by their high molecular weight, in the range of from about five hundred thousand to 10 million, preferably 1 million to 5 million, most preferably from about 1 million to 4 million, and by their water solubility, generally at least to an extent of up to about 5% by weight, or more, in water at 25° C.

Cross-linking of the above-described polymers may be accomplished by means known in the polymer arts, as by irradiation, or, preferably, by the incorporation into the monomer mixture to be polymerized of known chemical cross-linking monomeric agents, typically polyunsaturated (e.g. diethylenically unsaturated) monomers, such as, for example, divinylbenzene, divinylether of diethylene glycol, N,N'-methylene-bisacrylamide, polyalkenylpolyethers, and the like. The procedure described in U.S. Pat. No. 2,923,692 regarding the preparation of cross-linked polyacrylic acid is incorporated herein by reference. Typically, the amount of cross-linking agent to be incorporated in the final polymer may range from about 0.01 to about 1.5 percent, preferably from about 0.05 to about 1.2 percent, and especially, preferably from about 0.1 to about 0.9 percent, by weight of cross-linking agent to weight of total polymer. Generally, those skilled-in-the-art will recognize that the degree of cross-linking should be sufficient to impart some coiling of the otherwise generally linear polymeric compound while maintaining the cross-linked polymer at least water dispersible and highly water-swellable in an ionic aqueous medium.

The amount of the high molecular weight cross-linked polyacrylic acid compound required to provide a viscosity stabilizing effect will generally be in the range of about 0.01 to 0.5%, by weight, preferably from about 0.05 to 0.3% and most preferably from about 0.1 to about 0.2% by weight of the total detergent composition.

The liquid detergent composition of the invention may also optionally contain a swelling bentonite clay material as a fabric softening agent. These materials are colloidal clays (aluminum silicate) containing montmorillonite, available as sodium bentonite or calcium bentonite. These materials generally form a swellable colloidal suspension when mixed with water, which property can also aid in maintaining insoluble particulate materials, i.e., zeolites, suspended in the liquid medium. Where present in the composition, the bentonite is added at level in the range from about 1 to about 15% by weight.

The aqueous phase of the liquid detergent is electrolytic and thus contains a water soluble salt. Where the builder present in the detergent is itself a water soluble salt, e.g., where the builder is an alkali metal carbonate or citrate, no additional electrolyte need be added. Where the builder is water insoluble, e.g., a zeolite, then alkali metal halides or sulfates may be included as necessary to form the aqueous electrolyte solution.

The only other required component of the liquid detergent compositions in accordance with the present invention is water, some of which is present as a diluent in some formulation components, e.g., surfactants, and some of which is added when the formulation is prepared. Normally the hardness content of such water will be less than about 400 ppm as $CaCO_3$. Sometimes it may be desirable to utilize deionized water although city water will be satisfactory. While harder waters may be successfully employed in making the liquid detergent compositions of the present invention, it is considered that soft waters have less likelihood of producing some objectionable materials which could adversely affect the appearance of the liquid detergent or which could deposit objectionably on laundry during washing. The quantity of water present in the composition will generally range from about 25 to 70% by weight water. In more highly concentrated compositions, the quantity of water may range from about 25 to less than 60% by weight, more preferably less than 50% by weight.

Various adjuvants, both aesthetic and functional, may be present in the liquid detergent compositions of the present invention, such as fluorescent brighteners, perfumes and colorants. The fluorescent brighteners include the well known stilbene derivatives, including the cotton and nylon brighteners, such as those sold under the trademark Tinopal©, e.g. 5BM. The perfumes that are employed usually include essential oils, esters, aldehydes and/or alcohols, all of which are known in the perfumery art. The colorants may include dyes and water dispersible pigments of various types, including ultramarine blue. Titanium dioxide may be utilized to lighten the color of the product further or to whiten it. Inorganic filler salts, such as sodium sulfate and sodium chloride may be present, as may be antiredeposition agents, such as sodium carboxymethylcellulose; enzymes, such as proteases, amylases and lipases; bleaches, such as sodium perborate or percarbonate or chlorine-containing materials; bactericides; fungicides; antifoam agents, such as silicones; antisoiling agents, such as copolyesters; preservatives, such as formalin; foam stabilizers, such as lauric myristic diethanolamide; and auxiliary solvents, such as ethanol. Normally the individual proportions of such adjuvants will be less than 3%, often less than 1% and sometimes even less than 0.5%, except for any fillers and solvents, and additional detergents and builders, for which the proportions may sometimes be as high as 10%. The total proportion of adjuvants, including non-designated synthetic detergents and builders, will normally be no more than 20% of the product and desirably will be less than 10% thereof, more desirably less than 5% thereof. Of course, the adjuvants employed will be noninterfering with the washing and the softening actions of the liquid detergent and will not promote instability of the product on standing. Also, they will not cause the production of objectionable deposits on the laundry.

The viscosity of the liquid detergent composition immediately after completion of the formulation mixing procedure will generally range from about 500 to 20,000 centipoises (cps), measured using a Brookfield Viscosimeter Model LVT-II at an angular velocity of 12 rpm and at 25° C. Spindle no. 3 is used to measure viscosities below 10,000 cps and spindle no. 4 is used for viscosities above 10,000 cps. The more preferred viscosity will be in the range of from about 2,000 to 10,000 cps, most preferably in the range of 3,000 to 6,000 cps. The pH of the composition will generally be in the range of from about 7 to about 12, preferably 10 to 12, and pH may be adjusted if necessary by adding appropriate amounts of a basic solution such as 50% KOH.

The components of the detergent may be mixed in any suitable order which will lead to the development of a structured product. In accordance with one preferred procedure, water is mixed with a polymeric stabilizing agent (if such ingredient is required) and a source of alkalanity such as sodium hydroxide to neutralize the polymeric material. Builders are then added to this solution or slurry using a suitable high shear mixer to form a slurry/solution. The surfactant(s) are separately mixed to form a surfactant slurry. The deflocculating polymer in the form of an aqueous dispersion (solids content of 30 to 60%) may then be mixed with either slurry, and both slurries then combined under high shear mixing conditions, followed by the subsequent addition of perfumes, enzymes (if any) and other additives.

The following examples are illustrative of the invention. Unless otherwise indicated, all parts are by weight of active ingredients.

EXAMPLES 1–7

A series of zeolite-built, phosphorous-free superconcentrated heavy duty liquid detergent (SCHDL) formulations were prepared by mixing the components shown in Table 1 in the order shown in cylindrical tank with stirring using a Lightening® mixer. Mixing time was approximately 30 minutes. Example 7 is a control example which does not contain the deflocculating polymer. The identity and characteristics of the various deflocculating polymers used in all examples are as described below. In each case, the hydrophobe end capping group is docecyl mercaptan.

Deflocculating Polymer Physical Characteristics

| Polymer Designation | Polymer Type | Molecular Weight | Mole Ratio of Hydrophile:Hydrophobe |
|---|---|---|---|
| A | Acrylic-maleic | 4000 | 25:1 |
| B | Acrylic-maleic | 7000 | 25:1 |
| C | Acrylic | 4000 | 25:1 |
| D | Acrylic | 7000 | 100:1 |

TABLE 1

| | wt. % (Active Ingredient) | | | | | | |
|---|---|---|---|---|---|---|---|
| Component | Ex 1 | Ex 2 | Ex 3 | Ex 4 | Ex 5 | Ex 6 | Ex 7 (Cont) |
| Water | QS | QS | QS | QS | QS | QS | QS |
| Colorant | 0.75 | — | — | 0.75 | — | — | — |
| Sodium Citrate | 8.0 | 6.0 | 4.0 | 8.0 | 8.0 | 8.0 | 8.0 |
| Sodium Carbonate | 3.0 | 2.0 | 7.0 | 3.0 | 3.0 | 5.0 | 3.0 |
| Brightener | 0.5 | 0.15 | 0.5 | 0.5 | 0.5 | 0.5 | 0.5 |
| Preservative | 0.03 | 0.03 | 0.03 | 0.03 | 0.03 | 0.03 | 0.03 |
| Deflocculating Polymer | 1.0(D) | 0.5(B) | 1.0(C) | 1.0(C) | 1.0(C) | 1.0(C) | — |
| Zeolite A | 17.0 | 17.0 | 15.0 | 17.0 | 17.0 | 15.0 | 17.0 |
| Nonionic[a] Surfactant (Neodol 23-6.5) | 7.0 | 7.0 | 7.0 | 7.0 | 7.0 | 7.0 | 7.0 |
| Anionic** Surfactant (LAS) | 23.0 | 23.0 | 23.0 | 20.7 | 18.4 | 23.0 | 23.0 |
| Fragrance | 0.4 | 0.4 | 0.4 | 0.4 | 0.4 | 0.4 | 0.4 |
| Viscosity (cps) | 2320 | 6400 | 4660 | 3470 | 1280 | 2790 | >50000 |
| Separation at 110° F. after 4 weeks | 0% | 0% | 0% | 0% | 0% | 0% | 0% |

Note:
Neodol ® 23-6.5 is a nonionic ethoxylated fatty alcohol (6.5EO, 12–13 carbon atoms)
LAS is a linear alkylbenzene sulfonate (10–14 carbon atoms)

Viscosity comparison results contained in Table 1 show that the formulation of Examples 1–6 were all stable and exhibited low viscosities in the range of about 1280–6400 cps. Control Example 7 which does not contain one of the deflocculating polymers of the invention exhibited a viscosity in excess of 50,000 due to flocculation of the surfactant droplets present in the detergent.

EXAMPLES 8–11

A series of citrate-built, phosphate-free, enzyme-containing SCHDL formulations were prepared by mixing the components in Table 2 in the order shown by the procedure set forth above.

TABLE 2

| COMPONENT | wt % (Active Ingredient) Ex 8 | Ex 9 | Ex 10 | Ex 11 (Cont) |
|---|---|---|---|---|
| Water | QS | QS | QS | QS |
| LAS | 29.6 | 20.0 | 24.0 | 20.0 |
| AEOS* | | 5.5 | 4.0 | 9.5 |
| Nonionic Surfactant (Neodol 23-6.5) | 14.8 | 10.0 | 12.0 | 10.0 |
| Sodium Citrate | 10.0 | 10.0 | 10.0 | 10.0 |
| Borax | 2.0 | 2.0 | 2.0 | 2.0 |
| Glycerin | 4.0 | 4.0 | 4.0 | 4.0 |
| Protease | 1.5 | 1.5 | — | 1.5 |
| Deflocculating Polymer | 1.0(A) | 1.0(A) | 1.0(A) | — |
| Brightener | 0.4 | 0.4 | 0.4 | 0.4 |
| Colorant | 0.75 | 0.75 | 0.75 | 0.75 |
| Preservative | 0.05 | 0.05 | 0.05 | 0.05 |
| Fragrance | 0.40 | 0.40 | 0.40 | 0.40 |
| Viscosity (cps) | 2600 | 6700 | 2600 | 15000 |
| Separation 110° F. after 4 weeks | 0% | 0% | 0% | 31% |

Note:
*AEOS is an alkyl ethoxylated sulfate (3 EO, 12–15 carbon atoms)

The formulation of Example 11 (Control) which does not contain the deflocculating polymer exhibited a higher viscosity than formulations of Examples 8–10. In addition, the control formulation shows some phase separation after 4 weeks storage at 110° F., whereas the other formulations remained stable.

EXAMPLES 12–16

A series of phosphate-built SCHDL formulations were prepared by mixing the components shown in Table 3 in the order shown by the procedure set forth above.

TABLE 3

| COMPONENT | wt % (Active Ingredient) Ex 12 | Ex 13 | Ex 14 | Ex 15 | Ex 16 (Cont) |
|---|---|---|---|---|---|
| Water | QS | QS | QS | QS | QS |
| LAS | 26.0 | 26.0 | 25.0 | 25.0 | 25.0 |
| AEOS | 1.5 | 1.4 | 3.75 | 2.0 | 3.75 |
| Nonionic Surfactant (Neodol 25-7)* | — | 2.0 | — | — | — |
| Sodium IPP | 11.0 | 15.0 | 15.25 | 12.0 | 15.25 |
| Potassium TPP | 12.0 | 12.0 | 5.0 | 11.0 | 5.0 |
| Sodium Carbonate | 7.0 | 3.5 | 4.0 | 2.0 | 4.0 |
| Potassium Carbonate | — | — | 4.5 | — | 4.5 |
| Sesquicarbonate | — | — | — | 6.0 | — |
| Deflocculating Polymer | 0.4(A) | 0.7(C) | 0.65(C) | 0.65(C) | — |
| Brightener | 0.15 | 0.15 | 0.15 | 0.15 | 0.15 |
| Colorant | 1.5 | 1.5 | 1.5 | 1.5 | 1.5 |
| Preservatve | 0.03 | 0.19 | 0.19 | 0.19 | 0.19 |
| Fragrance | 0.33 | 0.33 | 0.35 | 0.33 | 0.35 |
| Viscosity (cps) | 5800 | 6500 | 5700 | 4800 | >30000 |

TABLE 3-continued

| COMPONENT | wt % (Active Ingredient) Ex 12 | Ex 13 | Ex 14 | Ex 15 | Ex 16 (Cont) |
|---|---|---|---|---|---|
| Separation 110° F. after 4 weeks | 0% | 0% | 0% | 0% | 4% |

Neodol ® 25-7 is a nonionic ethoxylated fatty alcohol (7 EO, 12–15 carbon atoms).

Formulations within the scope of the invention (Examples 12–15) all exhibited pourable viscosities in the range of 4800–6500 cps, whereas control formulation 16 had an initial viscosity in excess of 30,000 cps and showed some phase separation after 4 weeks storage.

EXAMPLES 17–18

Zeolite-built SCHDL formulations were prepared for purposes of comparison with and without a Carbopol®1623 polymer marketed by B. F. Goodrich. The components in the formulation are shown below in Table 4:

TABLE 4

| COMPONENT | Wt % (Active Ingredients) EXAMPLE 17 | EXAMPLE 18 |
|---|---|---|
| Water | QS | QS |
| LAS (anionic surfactant) | 18.9 | 18.9 |
| Teric G12A8[1] (C12–14 8EO alcohol) | 6.0 | 6.0 |
| AEOS (C12–14 3EO alcohol sulfate) | 1.0 | 1.0 |
| Zeolite A | 15.0 | 15.0 |
| Na Carbonate | 2.68 | 2.68 |
| Na Bicarbonate | 0.25 | 0.25 |
| Citric Acid | 5.23 | 5.23 |
| Deflocculating Polymer[2] | 0.75 | 0.75 |
| Minor Ingredients (Brightener, Preservative, Colorant, Perfume) | ~2.0 | ~2.0 |
| Carbopol ® 1623 | — | 0.135 |
| NaOH | 3.26 | 3.33 |

[1]Teric G12A8 is a nonionic ethoxylated fatty alcohol sold by ICI.
[2]Polymer designation C described in Examples 1–7.

The above-identified formulations were prepared in the following manner:

A stainless steel mixing vessel having a mixing shaft containing two A310 mixing blades was employed. The mixing shaft was located in the middle of the vessel and was run by an overhead motor.

To the mixing vessels there was added while mixing the water, citric acid, and for the formulation of Example 18, the Carbopol®. NaOH was then added until the pH of the solution was between 8–11. The minor ingredients, carbonate, bicarbonate deflocculating polymer and zeolite were then added. The slurry was mixed for about 10 minutes. The AEOS, nonionic and LAS were then added, followed by the perfume. The product was then mixed to the desired viscosity.

Samples of the product of Examples 17 and 18 were aged at room temperature and at 43° C. The results are shown below:

TABLE 5

Aging Study Showing Viscosity as a Function of Time

| | Example 17 | | Example 18 | |
|---|---|---|---|---|
| | Room Temp. | 43° C. | Room Temp. | 43° C. |
| Week 0 | 6400 cps | 6400 | 4600 cps | 4600 |
| Week 1 | 5200 | | 4000 | 5700 |
| Week 2 | 4400 | 2800 | 4500 | 6650 |
| Week 3 | 3800 | | 4500 | 6600 |
| Week 4 | 3800 | 1500 | 5000 | 6900 |

The product of Example 17, (containing no Carbopol®) decreased in viscosity after 4 weeks aging by 2,600 cps at room temperature (40% decrease) and by 4900 cps at 43° C. (75% decrease). The product of Example 18, (containing Carbopol®) maintained a constant viscosity at room temperature,and increased in viscosity at 43° C. after 4 weeks of aging.

What is claimed is:

1. A concentrated liquid detergent composition (CLDC) comprising lamellar surfactant droplets dispersed in an aqueous electrolytic continuous phase, said composition comprising mixture of:

a) from about 10 to 45% by weight of surfactant;

b) at least one detergent builder in an amount of from about 5 to 40%, by weight of said composition;

c) from about 0.01 to about 5% by weight of a deflocculating polymer composition containing acrylic polymer chains of the structure P-QR wherein P represents a polymer chain segment of a hydrophilic acrylic polymer, and QR represents a hydrophobic end-cap group wherein R is an organic hydrophobic radical containing from about 4 to 28 carbon atoms, and Q is selected from the group consisting of S, SO, and $SO_2$;

d) a polymeric stabilizing agent comprised of a high molecular weight cross-linked polyacrylic acid compound having a molecular weight greater than about one million in an amount from about 0.01 to about 0.5% by weight of the CLDC; and e) water.

2. The composition of claim 1 wherein said deflocculating polymer composition has a weight average molecular weight in the range of from about 1,000 to 50,000.

3. The composition of claim 1 wherein said surfactant comprises at least one anionic detergent selected from an anionic sulfate or sulfonate.

4. The composition of claim 3 containing from about 15 to 40% by weight of an alkyl benzene sulfonate anionic detergent having from about 9 to 20 alkyl carbon atoms.

5. The composition of claim 3 containing from about 1 to about 25% by weight of a sodium or potassium alkyl polyethoxy sulfate anionic detergent wherein the alkyl group contains from about 8 to 22 carbon atoms and the polyethoxy is of 2 to 7 ethylene oxide groups.

6. The composition of claim 4 wherein said an ionic detergent comprises a mixture of said alkyl benzene sulfonate and from about 1 to about 25% by weight of a sodium or potassium alkyl polyethoxy sulfate wherein the alkyl group contains from about 8–22 carbon atoms and the polyethoxy is of 2 to 7 ethylene oxide groups.

7. The composition of claim 4 further containing from about 1 to 20% by weight of a nonionic ethoxylated fatty alcohol wherein the fatty alcohol contains about 8 to 18 carbon atoms.

8. The composition of claim 1 wherein said hydrophilic polymer chain segment P is polyacrylic or polymethacrylic acid.

9. The composition of claim 1 wherein said hydrophilic polymer chain segment P is a copolymer containing at least 50% by weight of polymerized acrylic or methacrylic acid and less than 50% by weight of polymerized maleic acid or maleic anhydride.

10. The composition of claim 8 wherein said polymer has a weight average molecular weight in the range of from about 200 to 25,000.

11. The composition of claim 10 wherein said polymer has a weight average molecular weight in the range of from about 3,000 to 10,000.

12. The composition of claim 1 wherein R is an alkyl group containing from about 6 to 18 carbon atoms.

13. The composition of claim 12 wherein R is dodecyl.

14. The composition of claim 1 wherein from about 25 to 95% by weight of the hydrophilic polymer chains present in said 95% deflocculating polymer composition have said structure P-QR.

15. The composition of claim 1 wherein said deflocculating polymer composition contains an alkyl sulfide terminated polymer represented by the following structural formula:

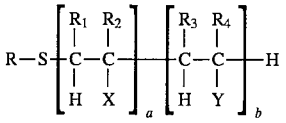

wherein R is a straight or branched chain primary, secondary, or tertiary alkyl group having 5 to 20 carbon atoms; $R_1$ and $R_3$ are each hydrogen, methyl, ethyl, or—COOH; $R_2$ and $R_4$ are each hydrogen, methyl, ethyl, —COOH, or —$CH_2$COOH; Y is selected from the group consisting of —COOH, —$CONH_2$, —$OCH_3$, —$OC_2H_5$, and —$CH_2$OH; X is selected from the group consisting of —$COOC_2H_4OH$, —$COOC_3H_6OH$, —$CONHCH_2OH$, —$CONHCH_3$, —$CONHC_2H_5$, —$CONHC_3H_7$, —$COOCH_3$, —$COOC_2H_5$, —CN, —$OOCCH_3$, —$OOCC_2H_5$, and —$COOCH_3CHOCH_2$; the degree of polymerization, a+b, is from 2 to 50 and the mole fraction of the monomer having the X functional group, a/(a+b) is from 0 to 0.6.

16. The composition of claim 1 wherein said deflocculating polymer composition contains an alkyl sulfoxide or alkyl sulfone-terminated polymer represented by the following structural formula:

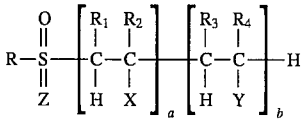

wherein R is a straight or branched chain primary, secondary, or tertiary alkyl group having 5 to 20 carbon atoms; $R_1$ and $R_3$ are each hydrogen, methyl, ethyl, or—COOH; $R_2$ and $R_4$ are each hydrogen, methyl, ethyl, —COOH, or —$CH_2$COOH; Y is selected from the group consisting of —COOH, —$CONH_2$, —$OCH_3$, —$OC_2H_5$, and —$CH_2$OH; X is selected from the group consisting of —$COOC_2H_4OH$, —$COOC_3H_6OH$, —$CONHCH_2OH$, —$CONHCH_3$, —$CONHC_2H_5$, —$CONHC_3H_7$, —$COOCH_3$, —$COOC_2H_5$, —CN, —$OOCCH_3$, —$OOCC_2H_5$, and —$COOCH_3CHOCH_2$; the degree of polymerization, a+b, is from 2 to 50, and the mole fraction of the monomer having the X functional group, a/(a+b) is from 0 to 0.6; and Z is either oxygen or not present such that when Z is oxygen the end-cap group is an alkyl sulfone and when Z is not present the end-cap group is an alkyl sulfoxide.

17. The composition of claim 1 wherein said detergent builder comprises one or more phosphates.

18. The composition of claim 1 wherein said detergent builder comprises a zeolite.

19. The composition of claim 1 wherein said detergent builder comprises an alkali metal citrate.

20. The composition of claim 1 wherein said detergent builder comprises an alkali metal carbonate.

21. The composition of claim 1 containing less than 60% by weight of water.

22. The composition of claim 1 containing less than 50% by weight of water.

23. The composition of claim 1 having a viscosity in the range of from about 500 to 20,000 cps.

24. The composition of claim 1 wherein said deflocculating polymer composition is present at a level of from about 0.25 to about 1.5%, by weight, of the liquid detergent composition.

25. The composition of claim 24 wherein the level of said deflocculating polymer composition is from about 0.4 to about 1.0%, by weight of the liquid detergent composition.

26. The composition of claim 1 wherein said amount of polyacrylic acid compound is sufficient to stabilize the viscosity of the CLDC such that over a four week period of aging at 43° C., its viscosity after four weeks is substantially the same or higher than the initial viscosity, and wherein by comparison a concentrated liquid detergent composition having the same composition as the aforesaid stabilized CLDC except for the absence of said polymeric stabilizing agent is characterized by a continuously decreasing viscosity whereby its viscosity after four weeks of aging at 43° C. is more than about 40% below the initial viscosity.

27. The composition of claim 26 wherein after four weeks of aging at 43° C. the viscosity of the aforesaid concentrated liquid detergent composition in the absence of polymeric stabilizing agent is more than about 60% below the initial viscosity.

28. The composition of claim 1 wherein said amount of polyacrylic acid compound is from about 0.05 to about 0.3% by weight.

29. A process for preparing a concentrated liquid detergent composition (CLDC) capable of maintaining a substantially constant viscosity upon storage at room temperature for a period of at least four weeks comprising the steps of:

(a) providing a mixing vessel containing
  (i) water,
  (ii) a polymeric stabilizing agent comprised of a high molecular weight cross-linked polyacrylic acid compound having a molecular weight greater than about one million in an amount to provide from about 0.01 to 0.5% by weight of said stabilizing agent in the prepared CLDC, and
  (iii) a source of alkalinity to neutralize the polymeric stabilizing agent;

(b) adding with agitation to the mixing vessel of (a), the following components:
  (i) from one detergent builder in an amount to provide from about 5%, to 40% by weight of the CLDC,
  (ii) surfactant in an amount to provide from about 10 to 45% by weight of the CLDC,
  (iii) a deflocculating polymer composition containing acrylic polymer chanis of the structure P-QR wherein P represents a polymer chain segment of a hydrophilic acrylic polymer, and QR represents a hydrophobic end-cap group wherein R is an organic hydrophobic radical containing from about 4 to 28 carbon atoms, and Q is selected from the group consisting of S, SO, and $SO_2$, and having a weight average molecular weight no greater than about 50,000 in an amount to provide from about 0.01 to about 5% by weight of the CLDC, and
  (iv) optionally minor additives such as perfume, preservative and brightener.

30. The process of claim 29 wherein said amount of polyacrylic acid compound is sufficient to stabilize the viscosity of the CLDC such that over a four week period of aging at 43° C., its viscosity after four weeks is substantially the same or higher than the initial viscosity, and wherein by comparison a concentrated liquid detergent composition having the same composition as the aforesaid stabilized CLDC except for the absence of said polymeric stabilizing agent is characterized by a continuously decreasing viscosity whereby its viscosity after four weeks of aging at 43° C. is more than about 40% below the initial viscosity.

* * * * *